US006336961B1

(12) United States Patent
Terai et al.

(10) Patent No.: US 6,336,961 B1
(45) Date of Patent: Jan. 8, 2002

(54) ELECTRIC PRECIPITATOR AND ELECTRIC PRECIPITATION ELECTRODE USED FOR THE SAME

(75) Inventors: Hiroshi Terai, Tokyo; Takuya Yamamoto, Kanagawa, both of (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/254,268

(22) PCT Filed: Jun. 22, 1996

(86) PCT No.: PCT/JP98/02769

§ 371 Date: Oct. 1, 1999

§ 102(e) Date: Oct. 1, 1999

(87) PCT Pub. No.: WO98/58744

PCT Pub. Date: Dec. 30, 1998

(30) Foreign Application Priority Data

Jun. 23, 1997 (JP) ..... 9-165549
Jun. 17, 1998 (JP) ..... 10-169444

(51) Int. Cl.[7] ..... B03C 3/76

(52) U.S. Cl. ..... 96/20; 96/30; 96/33; 96/34; 96/80

(58) Field of Search ..... 96/20, 30, 33–35, 96/80; 95/5, 76

(56) References Cited

U.S. PATENT DOCUMENTS

| | | | | |
|---|---|---|---|---|
| 2,588,364 A | * | 3/1952 | De Giorgi | 96/34 |
| 3,844,742 A | * | 10/1974 | Petersen | 96/35 |
| 4,502,870 A | * | 3/1985 | Wheeler | 96/33 X |

FOREIGN PATENT DOCUMENTS

| | | | | |
|---|---|---|---|---|
| DE | 3500431 | * | 7/1986 | 96/35 |
| JP | 54-85481 | | 7/1979 | |
| JP | 61-191140 | | 11/1986 | |
| JP | 63-52539 | | 10/1988 | |
| JP | 63-185461 | | 11/1988 | |
| WO | WO98/58744 | | 12/1998 | |

* cited by examiner

*Primary Examiner*—Richard L. Chiesa
(74) *Attorney, Agent, or Firm*—Arent Fox Kintner Plotkin & Kahn PLLC

(57) ABSTRACT

A plurality of discharge electrodes are grouped for respective gas passages that are defined by collecting electrodes (11–15). The discharge electrodes in each group are connected to a common power supply unit for receiving output voltage through a diode provided for each group and are connected to a spark electrode (21). The spark electrode is positioned such that it sparks between a hammer (20) in a passageway of the hammer upon striking. Each group of the discharge electrodes has a ground unit to be grounded just before the collecting electrodes on both sides thereof are struck.

3 Claims, 10 Drawing Sheets

ELECTRIC PRECIPITATOR AND ELECTRIC PRECIPITATION ELECTRODE USED FOR THE SAME

This application is a national stage application of International Application No. PCT/JP981 02769, filed on Jun. 22, 1998.

TECHNICAL FIELD

The present invention relates to an electric dust precipitator and, more particularly, to an improvement of an electric dust precipitator comprising a hammering assembly that applies mechanical impact to collecting electrodes or precipitation electrodes to shake off the collected dust on the surface thereof, as well as an improvement of the collecting electrodes therein.

BACKGROUND ART

Referring to FIGS. 1 and 2, a conventional hammering assembly for an electric dust precipitator is described for its configuration and electrical connections with collecting electrodes and discharge electrodes. In a charging division housing in the electric dust precipitator, grounded collecting electrodes 11 through 15 (15 is omitted in FIG. 1) are placed. Each of the collecting electrodes 11 through 15 is provided with a hammering assembly comprising a hammer 20 and a struck seat 24 which is provided at a lower portion of the corresponding collecting electrode. The hammers 20 are pivotally mounted on a common shaft 21 with fork ends 22 and pins 23. Rotation force is transmitted from a motor (not shown) to the shaft 21 via a reduction gear mechanism, which causes the shaft 21 to rotate at a low speed in the direction depicted by an arrow in the figure. Rotation of the shaft 21 lifts the hammer 20 to the uppermost point of its movement. The hammer 20 then swings because of the gravity and strikes the struck seat 24. The vibration generated by the hammer strike is transmitted to the collecting electrode and the collected dust is shaken off from the collective electrode surface.

Since the hammers 20 are attached to the shaft 21 at a different angle with respect to each other, the hammer 20 strikes the corresponding struck seat 24 from one to another. This is for preventing the collected dust from re-scattering simultaneously at two or more collecting electrodes after having been shaken off by the hammers. In other words, the collected dust is re-scattered in turn to make re-scattered puff (a cloud of visible smoke) inconspicuous that is escaped through a chimney into the air.

On the other hand, a plurality of discharge electrodes are placed between the adjacent collecting electrodes. In FIG. 2, four discharge electrodes A1 through A4 are placed between the collecting electrodes 11 and 12. Likewise, four discharge electrodes B1 through B4 are placed between the collecting electrodes 12 and 13, four discharge electrodes C1 through C4 are placed between the collecting electrodes 13 and 14, and four discharge electrodes D1 through D4 are placed between the collecting electrodes 14 and 15. All discharge electrodes are connected to a common power supply unit 30. The power supply unit 30 comprises a transformer 31, a rectifier bridge circuit 32 connected to a secondary output of the transformer 31, and a spark detection voltage divider 33. A primary input of the transformer 31 is connected to an alternative current power supply AC through two controlling thyristors 35. A control unit 36 controls a conduction angle of the thyristor 35, which in turn controls the voltage across the secondary output of the transformer 31. More specifically, the control unit 36 monitors the voltage across the spark detection voltage divider 33 to determine the presence or absence of spark between the discharge electrode and the collecting electrode and controls the voltage across (or the current flowing through) the secondary output to have a proper value.

Though only five collecting electrodes and sixteen discharge electrodes are illustrated in FIGS. 1 and 2, an actual electric dust precipitator has several tens of collecting electrodes aligned transversally with respect to a gas flow and several hundreds of discharge electrodes.

As described above in conjunction with FIG. 1, the collected dust is shaken off from the surface of the collecting electrodes upon their vibration generated by the hammers. Although the dust is then fallen down as a mass into a lower hopper, a part of the falling dust is carried by the gas flow. This phenomenon is referred to as "re-scattering" by hammering and has been an obstacle to improved dust collecting capacity of the electric dust precipitator. In addition, hammering may not shake the collected dust completely off the surface of the collecting electrodes. The collected dust remained on the surface may re-scatter without being hammered off. Furthermore, accumulation of the collected dust on the electrode surface, if happened, may be a cause of back discharge and spark. Such a hammering technique is thus desired that can shake off the collected dust as much as possible without causing re-scattering thereof.

Conventional hammering has been made while applying the voltage to the discharge electrodes of the electric dust precipitator. For more complete shaking off of the collected dust, the hammering may be made by means of hammering with reduced voltage than usual or a power off rapping that the hammer strikes the collecting electrode with the power supply completely turned off. Since the hammering with the reduced voltage and the power off rapping require to reduce or eliminate the voltage, it may deteriorates the dust collecting function of the electric dust precipitator or even prevents the precipitator from displaying its function.

In the hammering assembly, slow rotation of the shaft 21 lifts the hammers 20 one by one to their respective uppermost point and the hammers 20 swing due to the gravity from the upper limit of their movement to the struck seat 24. It takes several minutes for the shaft 21 to rotate once, so that the hammering with the reduced voltage or the power off rapping continues for at least several minutes and that the dust collecting capacity may be deteriorated during this length of time. The power off rapping is seldom used due to this problem. The power off rapping is used only under limited conditions. The limited conditions are the case that the dust collecting capacity has sufficient margins during operation of a plant including the electric dust precipitator at a significantly lower load than in the normal operating status. In other words, the power off rapping may be used if necessary only when sufficient dust collecting capacity can certainly be achieved even after down-time of one of the charging division housings in the electric dust precipitator.

The present inventor has found that the hammering based on the conventional hammering technique with the application of the voltage can shake off the dust only incompletely with a disadvantageously and relatively large amount of re-scattering dust. The present inventor has developed an apparatus to monitor motion of dust particles in the air separated by the hammering from the collecting electrodes of the electric dust precipitator and has examined behavior of the separated dust particles.

This is described more in detail below with reference to FIG. 3. According to the results of the observation, the collected dust can hardly be shaken off by the hammering without being accumulated to a significant thickness on the collecting electrodes 11 and 12 at a position opposed to a corona generating region Cg (R1 region in FIG. 3). On the other hand, the collected dust is shaken off from the surface of the collecting electrodes 11 and 12 at a remaining position away from the R1 region and not being opposed to the corona generating region Cg. Instead, the collected dust scatters in the air (R2 region in FIG. 3). In this way, it has been found that the shaking off is incomplete at and around the R1 region while the re-scatter by the hammering occurs at and around the R2 region.

A reason for this difference between the R1 and the R2 regions would be as follows. A large amount of negative ions generated around the discharge electrode A collides against the surface of the collected dust at the R1 region, producing negative charges on the dust. The collecting electrodes 11 and 12 attract the charged dust strongly and the latter is difficult to be shaken off.

On the contrary, few or no negative ions collide against the surface of the collected dust at the R2 region. In this case, electric field is generated by the voltage between the discharge electrode A and the collecting electrodes 11 and 12, the electric field produces positive charges in the direction from the collecting electrodes (metallic portion) to the surface of the collected dust, and the positive charges are accumulated onto the surface of the collected dust as the positive charges. The positive charges on the surface of the accumulated or the collected dust are not neutralized because few or no negative ions collides from outside against the dust. Accordingly, the collected dust is attracted by the discharge electrode A and re-scatters in the air after being shaken off by the hammering.

The re-scatter of the dust occurs in a larger area at the R2 region during the hammering with the reduced voltage because there is less negative ions than in the power off rapping. The voltage resides for a significant length of time after discontinuing application of the voltage because of a capacitance between the discharge electrode and the collecting electrodes in the power off rapping. The re-scattering of the dust by the sequential hammering occurs on the entire surface of the collecting electrodes 11 and 12 until the voltage is eliminated.

The above-mentioned problems have been an obstacle to a hammering technique that allows more complete shaking off of the dust while scattering less or no dust in the air.

In spite of the above circumstances, recent electric dust precipitators are required to achieve an outlet dust concentration of 10 mg/m$^3$ N or less. Therefore, reduction of the amount of the dust re-scattered by the hammering is essential from the environmental viewpoints.

With respect to the above-mentioned problems, an object of the present invention is to provide an electric dust precipitator that can provide a high dust collecting capacity by means of reducing an amount of the dust re-scattered by hammering.

Another object of the present invention is to provide an electric dust precipitator of which dust collecting capacity is less or not deteriorated even during power off rapping.

It is yet another object of the present invention to provide a collecting electrode suitable for the above-mentioned electric dust precipitator.

DISCLOSURE OF THE INVENTION

An electric dust precipitator according to a first invention comprises a plurality of collecting electrodes and a plurality of hammering assemblies for collected dust, each of which is mounted on each of the collecting electrodes and each of which has a hammer.

According to an aspect of the present invention, a plurality of discharge electrodes are grouped into a plurality of groups and the discharge electrodes of each group are placed in each of gas passages each of which is defined by the plurality of collecting electrodes. The discharge electrodes in each group are connected to a common power supply unit for receiving output voltage through a diode provided for each group and are connected to a spark electrode. The spark electrode is positioned such that it sparks between the hammer in a passageway of the hammer upon striking. Each group of the discharge electrodes has a ground unit to be grounded by the spark just before the collecting electrodes on both sides thereof are struck.

An electric dust precipitator according to a second invention comprises a plurality of collecting electrodes housed in each charging division housing and a plurality of hammering assemblies for collected dust, each of which is mounted on each of the collecting electrodes and each of which has a hammer.

According to another aspect of the present invention, it is constructed so that the collecting electrodes are struck by the hammers at the same time. All discharge electrodes in the charging division housing are connected to a common power supply unit to receive output voltage therefrom and are connected to a common spark electrode. The spark electrode is positioned such that the spark electrode sparks, just before the striking by the hammer, between it and the hammer or another moving member that moves in cooperation with or in synchronism with the hammer. Each group of the discharge electrodes has a ground unit to be grounded by the spark just before the collecting electrodes are struck.

The collecting electrode according to the present invention is applied to an electric dust precipitator comprising a plurality of collecting electrodes housed in each charging division housing and a plurality of hammering assemblies for collected dust, each of which is mounted on each of the collecting electrodes and each of which has a hammer. Each collecting electrode is formed of two plates placed in parallel with a gap of several millimeters or larger to form a dust chute therebetween. The plates are louver-shaped. The louver is designed to receive the dust separated and fallen from the outside the plates and guide it into the dust chute.

BEST MODE FOR EMBODYING THE INVENTION

Figure 1:
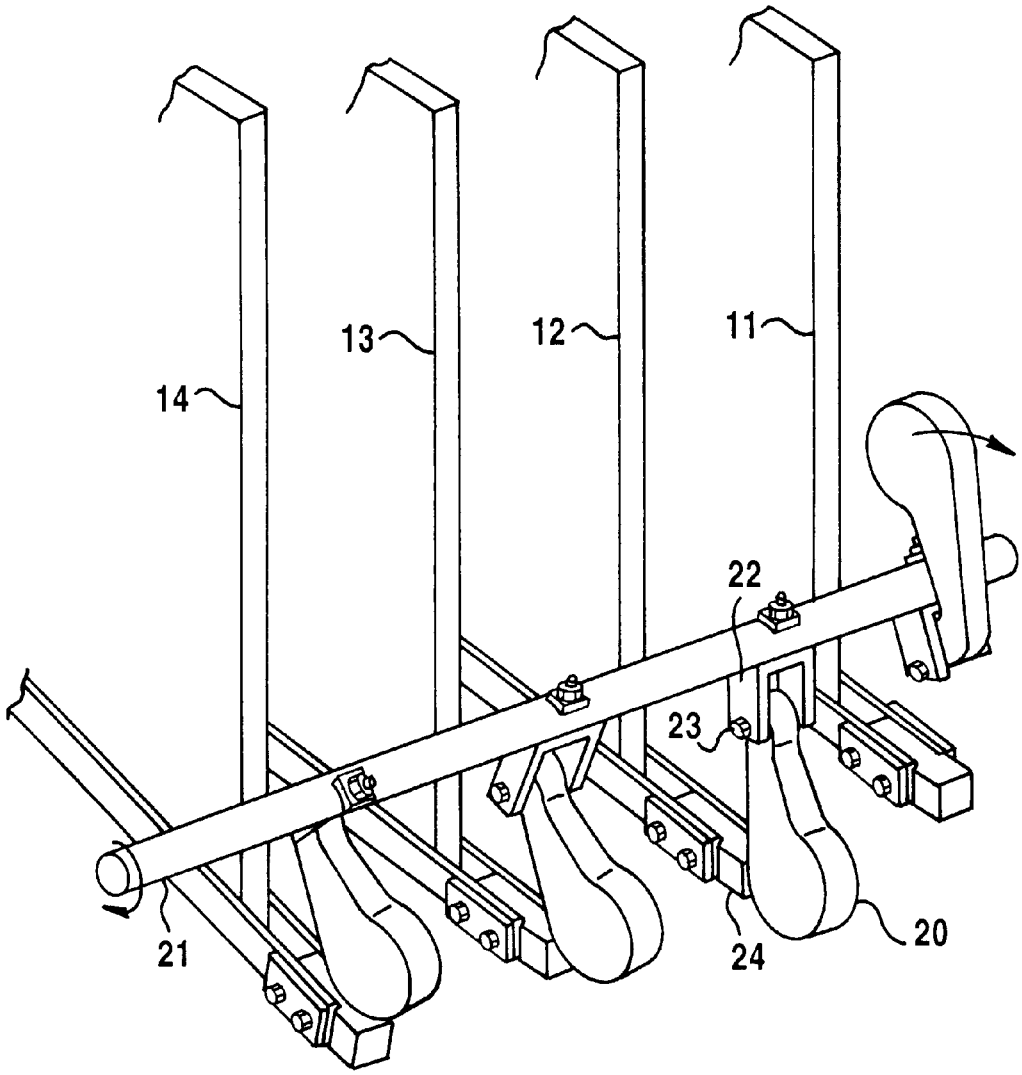
FIG.1 PRIOR ART
FIG. 1 is a view illustrating configuration of a hammering assembly in a conventional electric dust precipitator.
Figure 2:
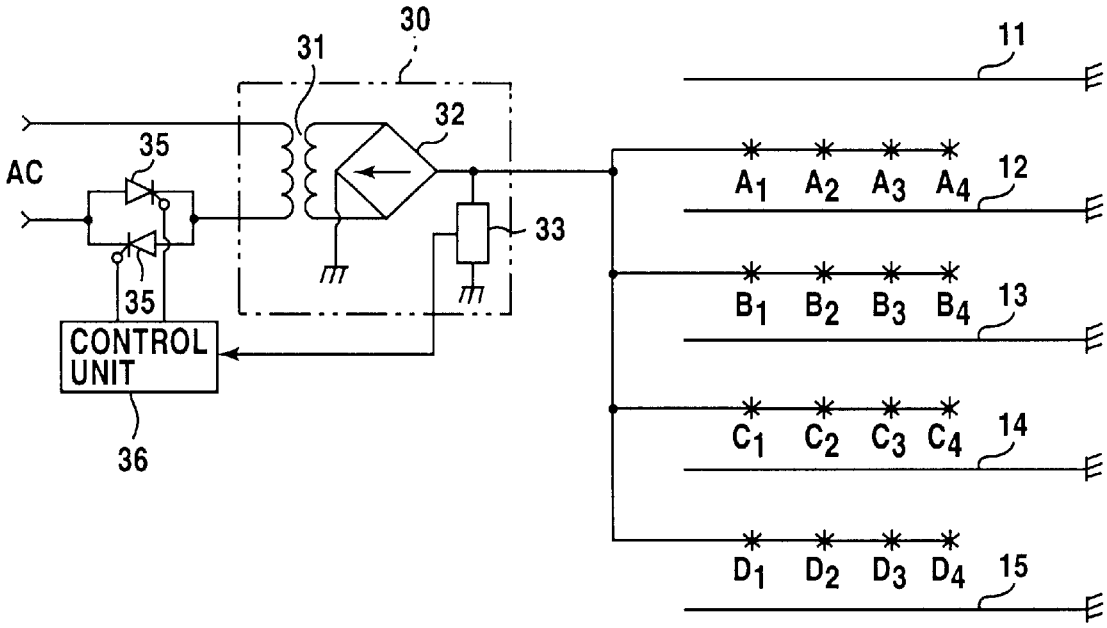
FIG.2 PRIOR ART
FIG. 2 is a view illustrating electrical connections between a power supply unit and discharge electrodes in the conventional electric dust precipitator.
Figure 4:
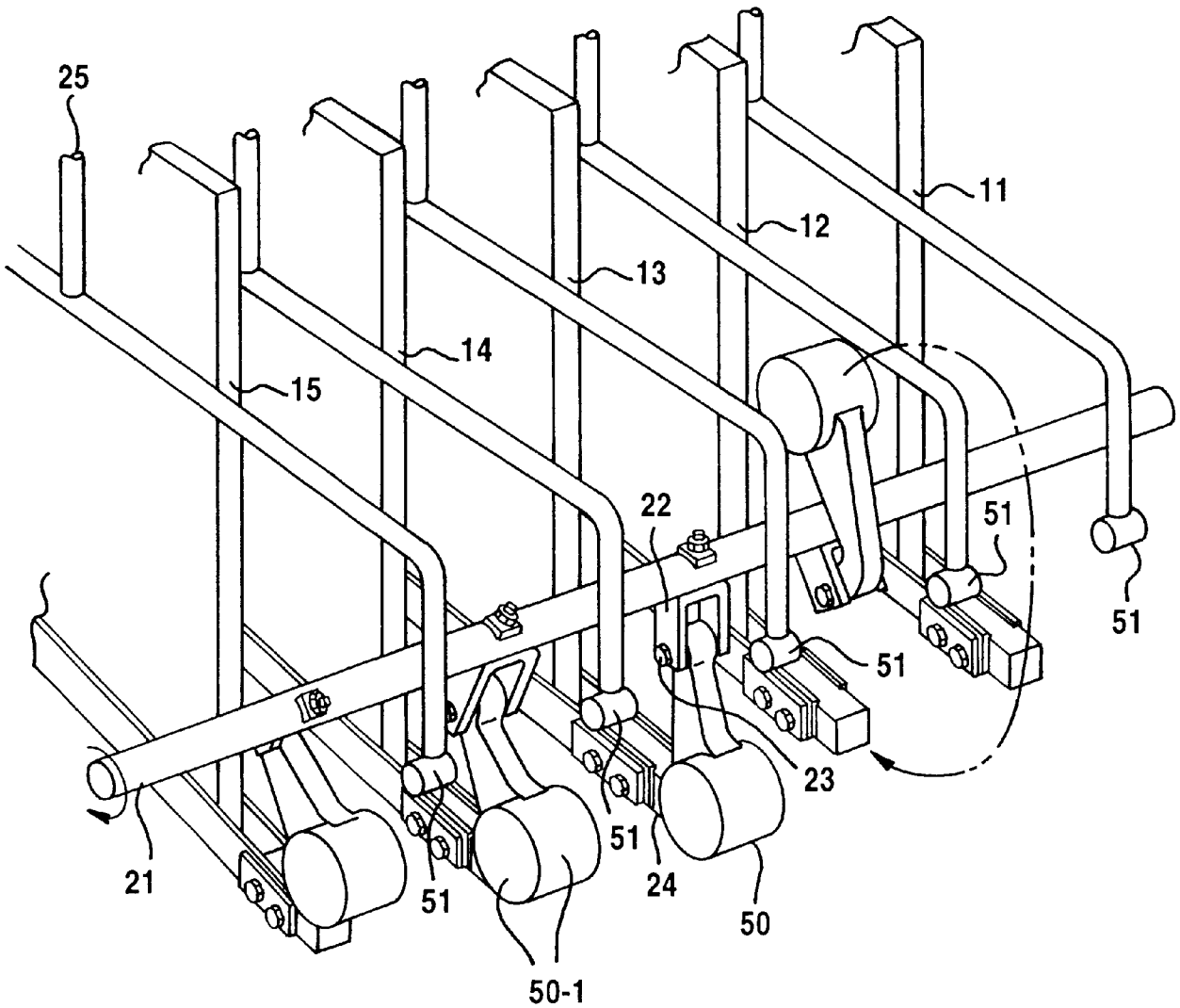
FIG. 4 is a view illustrating configuration of a hammering assembly and a spark electrode in an electric dust precipitator according to a first embodiment of the present invention.
Figure 5:
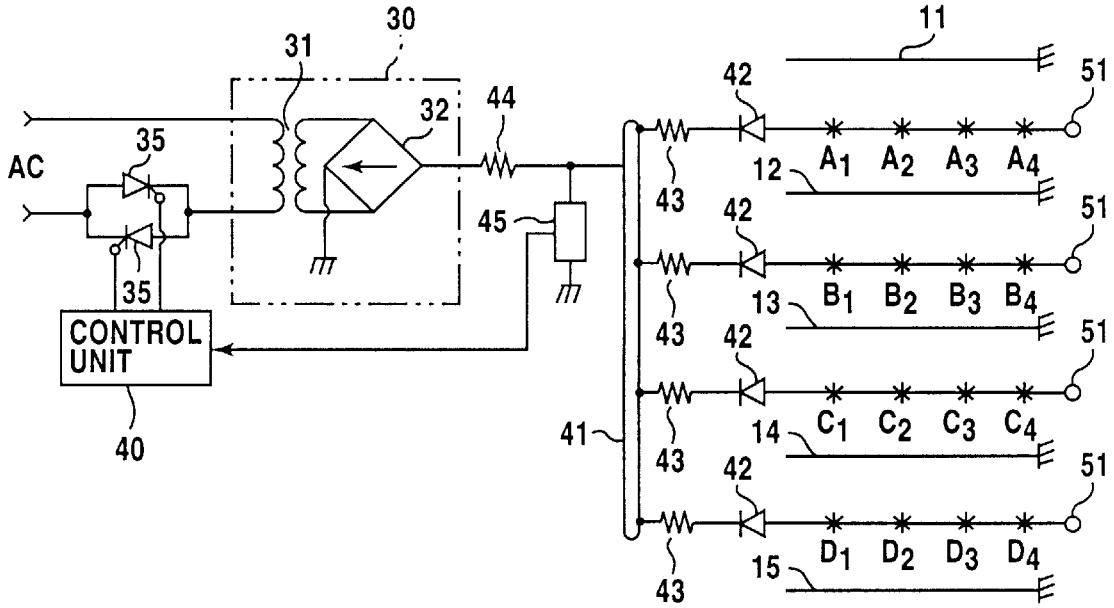
FIG. 5 is a view illustrating electrical connections between a power supply unit and discharge electrodes in the electric dust precipitator shown in FIG. 4.

Referring to FIGS. 4 and 5, an electric dust precipitator according to a first embodiment of the present invention is described. For convenience, description proceeds for a case where five collecting electrodes or precipitation electrodes 11 through 15 are provided for each charging division housing in the electric dust precipitator and discharge electrodes A1 through A4, B1 through B4, C1 through C4, and D1 through D4 are aligned between the adjacent respective collecting electrodes. Similar component parts to those in FIGS. 1 and 2 are therefore depicted by the same reference numerals and detailed description thereof will be omitted. In FIG. 5, each charging division housing in the electric dust precipitator includes a single power supply output bus 41 for supplying high voltage from a single common power supply unit 30 to the all discharge electrodes therein. The discharge electrodes are grouped and placed for each gas passage (hereinafter, referred to as a duct) sandwiched between two adjacent collecting electrodes. Several discharge electrodes are placed in one duct and form a group of the discharge electrodes connected in series to each other. The group of the discharge electrodes in each duct receives power supply from the power supply output bus 41 through a diode 42. The diode 42 is connected in series to a resistor 43. Another resistor 44 is inserted between the power supply unit 30 and the power supply output bus 41. The reason for this configuration is to limit an electrical current flowing through the diode 42 upon generation of a spark not to be excess. Though two resistors 43 and 44 are used in this embodiment, one of which may be eliminated.

A control unit 40 controls voltage across a secondary output of a transformer 31. The control unit 40 also determines the presence or absence of the spark in a detected voltage supplied from a spark detection voltage divider 45. The control unit 40 disconnects the power supply unit 30 for a short period of time when it detects the presence of the spark.

In FIG. 4, the hammering assembly according to this embodiment is different from conventional similar hammering assemblies in the shape of hammers 50 and spark electrodes 51. Similar to a typical conventional electric dust precipitator, one hammer 50 is provided for one collecting electrode. The hammer 50 swings because of the gravity and strikes the struck seat 24. The hammer 50 has head portions 50-1 projected horizontally to the right and the left directions. The hammers 50 and the shaft 21 are made of an electrically conductive material and connected to the ground. The spark electrodes 51 are positioned to be several centimeters (e.g., 5 cm) or less away from the route or the passageway of the head portions 50-1 of the hammer 50 during its swing due to the gravity. The spark electrodes 51 may be connected to the groups of the discharge electrodes either in the right or the left duct in the figure relative to the collecting electrode to be struck or hammered by the hammer 50. The spark electrodes 51 are provided for the corresponding hammer. It is noted that the spark electrode connected to the groups of the discharge electrodes in a certain duct may be shared for both hammers corresponding to the collecting electrodes on the right and the left sides thereof.

Figure 6:
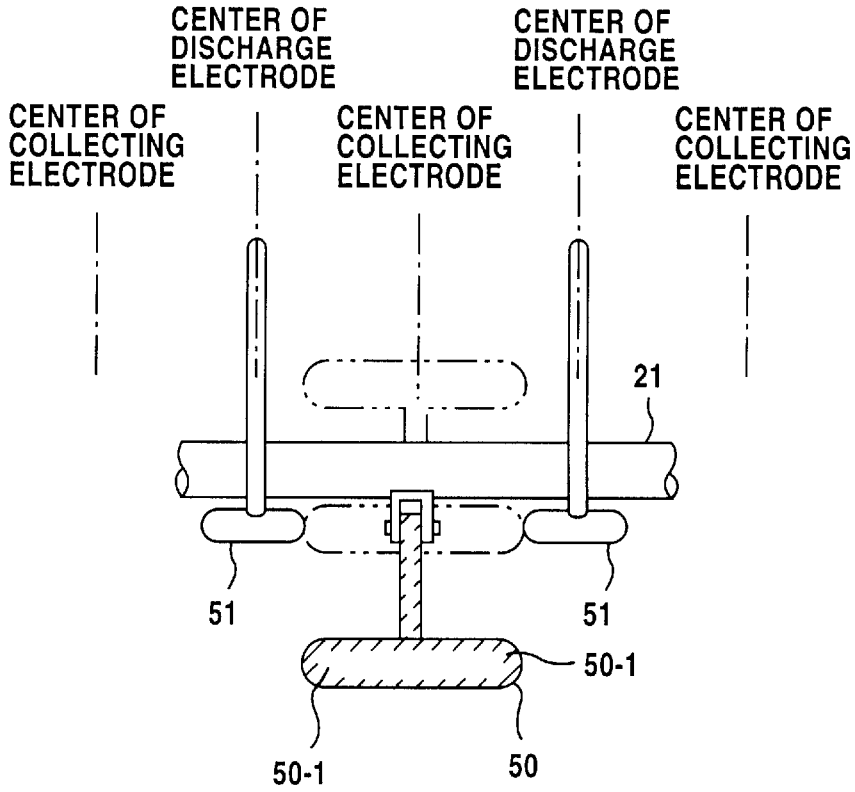
FIG. 6 is a front view of a part of another hammering assembly similar to the one shown in FIG. 4.
Figure 7:
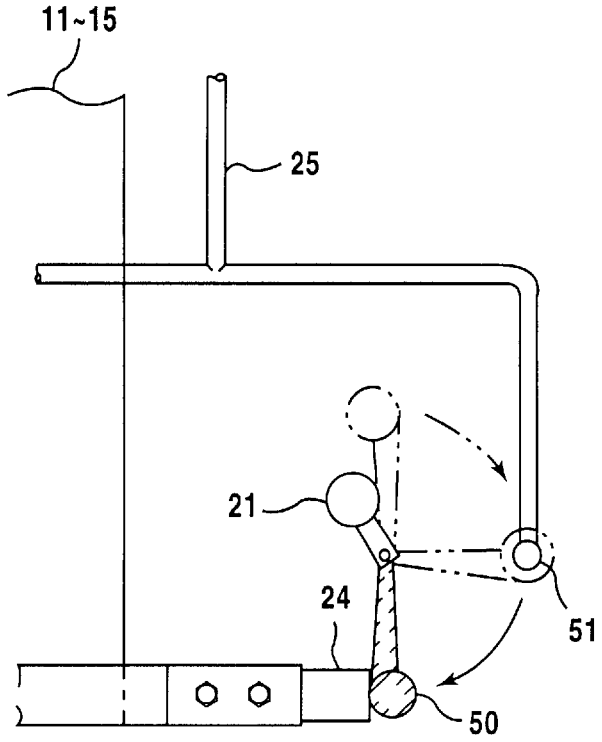
FIG. 7 is a side view of the hammering assembly shown in FIG. 6.

As shown in FIGS. 6 and 7, the spark electrode 51 may be positioned to contact with the head portions 50-1 of the associated hammer 50. With this configuration, the hammer 50 strikes the spark electrodes 51 that are mechanically coupled to the group of the discharge electrodes when the hammer 50 swings due to the gravity. This provides a function of hammering the discharge electrodes as well. Each discharge electrode is supported by a support frame 25.

Turning back to FIG. 5, the control unit 40 has a spark determination function. Upon determining that there is a spark, the control unit 40 controls controlling thyristors 35 on a primary side of the transformer 31 to disconnect the output of the power supply unit 30 for 0.008-1 second(s).

Figure 8A:
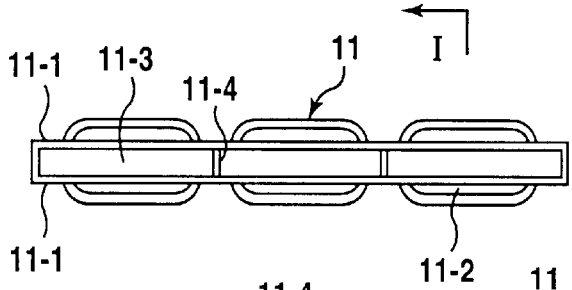
FIGS. 8A and 8B are respectively a plan view and a front view for describing the configuration of a collecting electrode used in the present invention.
Figure 8B:
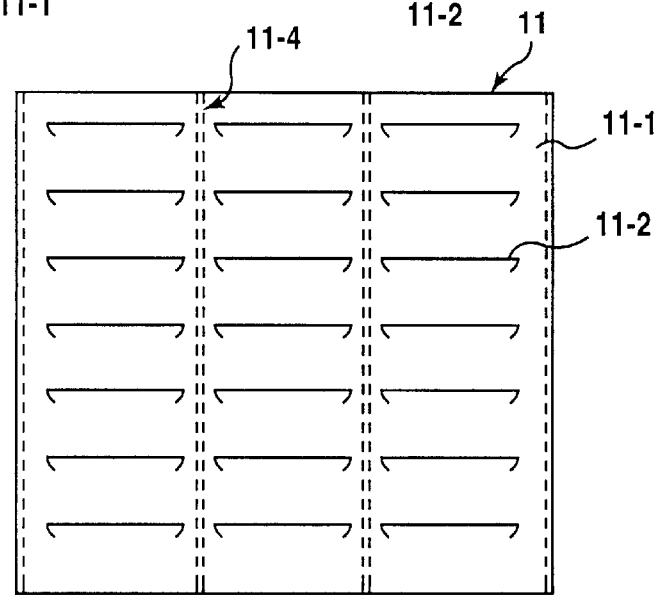
Figure 9:
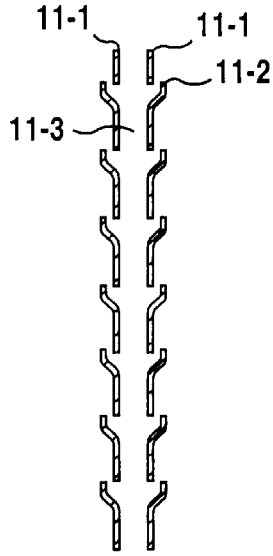
FIG. 9 is a cross-sectional view of the collecting electrode taken on line I in FIG. 8(A)

Referring to FIGS. 8 and 9, a structure of the collecting electrode is described. As for the collecting electrode 11, two plates 11-1 are placed in parallel with a gap of at least several millimeters therebetween and a dust chute 11-3 is formed between the plates. Each plate 11-1 has a louver-shaped pocket 11-2. Each pocket 11-2 is opened in the upward direction so that the dust fallen down from the outside the two plates is received and guided into the dust chute 11-3. Each pocket 11-2 is also opened in the downward direction to guide the received dust into the dust chute 11-3.

A plurality of partition walls 11-4 are placed between the plates 11-1 to form compartments there and to reinforce the collecting electrode. Without the partition walls 11-4, a gas flow may occur by the gas in the duct entering the dust chute 11-3 through the upper opening of the pocket 11-2 and back to the duct through the lower opening of the pocket 11-2. Should the gas flow like the above occur, the dust falling down through the dust chute may be brought away with the gas. The partition walls 11-4 are to solve such a problem.

The bottom of the dust chute 11-3 is opened towards a hopper (not shown) provided at a position sufficiently lower than the duct and the falling dust is introduced into the hopper.

It is desirable that the plates 11-1 keep a smooth surface without any rust after a long service period and that the plates 11-1 are preferably formed of stainless steel material.

It is desirable that the diodes 42 in FIG. 5 are used in an environment of 100° C. or lower from the viewpoint of their properties. Since the gas temperature upon collection is often higher than 100° C. and the gas itself is contaminated, it is necessary to place the diodes 42 in clean air of 100° C. or lower completely insulated from such a contaminated hot gas environment.

Figure 10A:
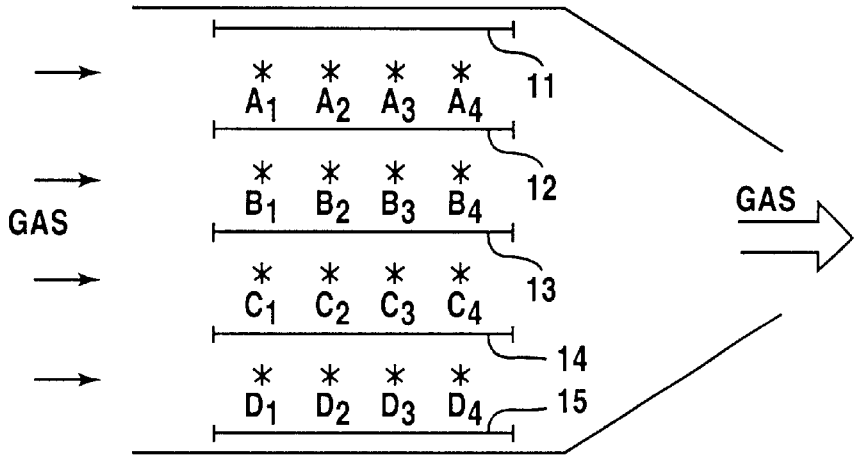
FIGS. 10A and 10B are respectively a horizontal sectional view and a vertical sectional view for describing the arrangement of electrodes in the electric dust precipitator according to the present invention.
Figure 10B:
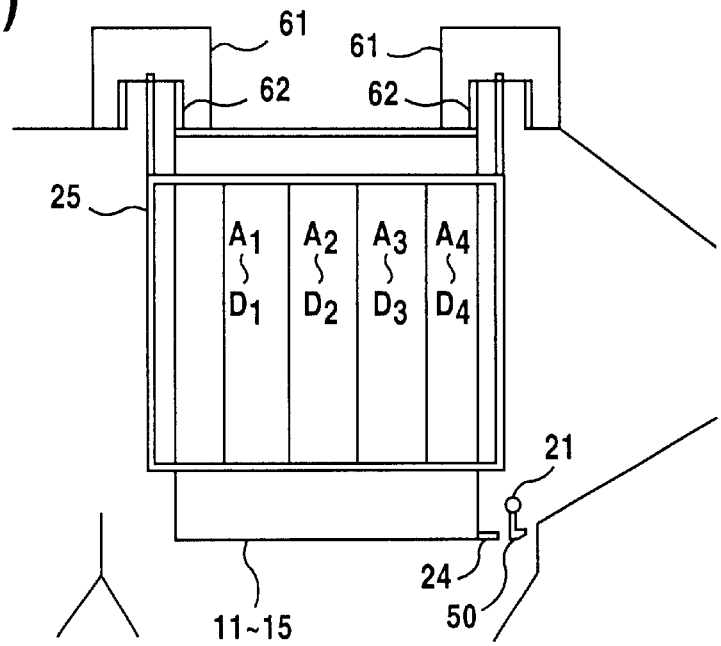

As shown in FIG. 10, an insulator chamber 61 is provided at an upper portion of the electric dust precipitator and is purged with the clean air of 100° C. or lower. The insulator chamber 61 houses the power supply output bus 41 as well as support insulators 62, the diodes 42, resistors 43 and/or 44 for the current control, all of which are provided for the corresponding duct. With conventional connection, only four support insulators are required for the discharge electrodes to fix four corners of the discharge electrode support frame that holds the discharge electrodes at place. In the embodiment, it is necessary that the discharge electrode support frame 25 is supported at one or two position(s) for each duct. Therefore, the number of the support insulators 62 for the discharge electrodes should be the same as or double of the number of the ducts. It is noted that the weight (mass) of the discharge electrodes supported per support insulator 62 is several-ten times smaller than that supported by the conventional support insulator. Thus, the support insulators 62 are not required to have a high mechanical strength.

An aspect of the present invention is the combination of the connection as shown in FIG. 5, the spark electrodes in FIG. 4 or 6, and the collecting electrodes having the structure illustrated in FIG. 8. With the connection as shown in FIG. 5 and the spark electrodes shown in FIG. 4 or 6, the shape of the collecting electrodes is not limited to the louver shape illustrated in FIG. 8.

Next, operation is described. In this embodiment where the connection as shown in FIG. 5 is combined with the spark electrodes in FIG. 4 or 6, the discharge electrodes are ground on the right and the left sides of the collecting electrode struck by the hammer 50 that is just swung by the gravity because of the spark by the hammer 50 or of the contact with the spark electrodes 51. The hammer 50 strikes the struck seat 24 just after the sparking, so that the discharge electrode is struck with zero voltage, and that the dust on the collecting electrodes can be shaken off effectively.

As a result of the grounding of the discharge electrodes, the voltage across the power supply output bus 41 also drops via the diode 42 in addition to the voltage elimination of the grounded discharge electrode. The control unit 40 then detects the spark and disconnects the output of the power supply unit for 0.008–1 second(s). The voltage across the discharge electrode is kept at zero (ground potential). Even though there is a slight difference between the spark timing and the time when the hammer 50 carries out the hammering, it is possible to carry out the hammering under the condition that the voltage across the discharge electrode is ensured to be at the zero level (ground potential).

On the other hand, the discharge electrodes in the ducts other than those on both sides of the collecting electrode struck have charges thereon because of the capacitance between the discharge electrode and the adjacent collecting electrode. Upon dropping down of the voltage across the power supply output bus 41, or even elimination of the voltage due to the disconnection of the power supply to the power supply output bus 41, the voltage across the discharge electrodes kept by the capacitance makes the associated diode 42 be reverse-biased to turn off it. As a result, the accumulated charges on the discharge electrode are lost gradually by corona discharge on the discharge electrode, rather than being transferred to the power supply output bus 41. Along with this, the voltage across the discharge electrodes reduces gradually and it takes about 0.1–0.5 seconds for the voltage to reach a corona start voltage level. During this period of time the corona is kept though quite weak, and the voltage kept is not lower than the corona start voltage level, the dust collection is therefore not interrupted and continues well.

In this embodiment, collection of the dust continues with the discharge electrodes producing the corona in the duct other than those on both sides of the collecting electrode struck. This means that a larger number of the ducts allows to provide the dust collecting capacity that is not so much deteriorated as a whole even when no voltage is applied to the discharge electrodes on both sides of the collecting electrode struck. The hammering is conducted with the zero voltage across the discharge electrode, so that the dust can be separated easily by the hammering and be fallen straight down into the hopper. This achieves shake-off of the dust with less re-scattering. This will be described more in detail below.

As described above, electric field generated by the negative voltage across the discharge electrode induces positive charges in a wide region of the deposition of the collected dust on the collecting electrode in the electric dust precipitator which direct current voltage is applied to and the positive charges are accumulated on the surface of the collected dust deposition. By hammering the collecting electrode while applying the voltage, the dust having the positive charge thereon separates from the surface and scatters away towards the discharge electrode and the scattered dust particles are carried by the gas flow and re-scatter in the air.

On the contrary, by hammering the collecting electrode with the zero voltage across the discharge electrode, the separated dust never scatters away and just falls down along the surface of the collecting electrode. It is expected that the dust does not attracted by the discharge electrode because no electrical field is generated.

According to this embodiment, the voltage across the discharge electrodes is at the zero level in the ducts on both sides of the collecting electrode struck and the dust separated from the collecting electrode falls straight down along the surface of the collecting electrode. Since the duration when the voltage is zero is as short as 0.008–1 second(s), the dust is charged again by the negative ion on the course of falling down and is then attracted by the collecting electrode. While the collected dust on the collecting electrodes repeats the cycle of separation, falling down, and re-adsorption to the collecting electrode, the dust moves a little, gradually downward and enters the pocket 11-2 in the collecting electrode shown in FIG. 8. The dust in the pocket 11-2 is shaken off into the dust chute 11-3 when the collecting electrode is struck again and falls straight down into the hopper. This procedure ensures collection of the dust into the hopper without causing a problem of the re-scattering of the dust.

In the electric dust precipitator described above, the performance as a whole is not significant because the dust collection continues on the discharge electrodes in the ducts other than those on both sides of the collecting electrode struck.

However, any deterioration of the dust collecting capacity is not desirable even if it is not so significant. This slight deterioration of the performance results from the reduction of the voltage across the discharge electrodes in the ducts other than those on both sides of the struck collecting electrode, to a level where only extremely weak corona can be generated during the time where no voltage is applied to.

Figure 11:
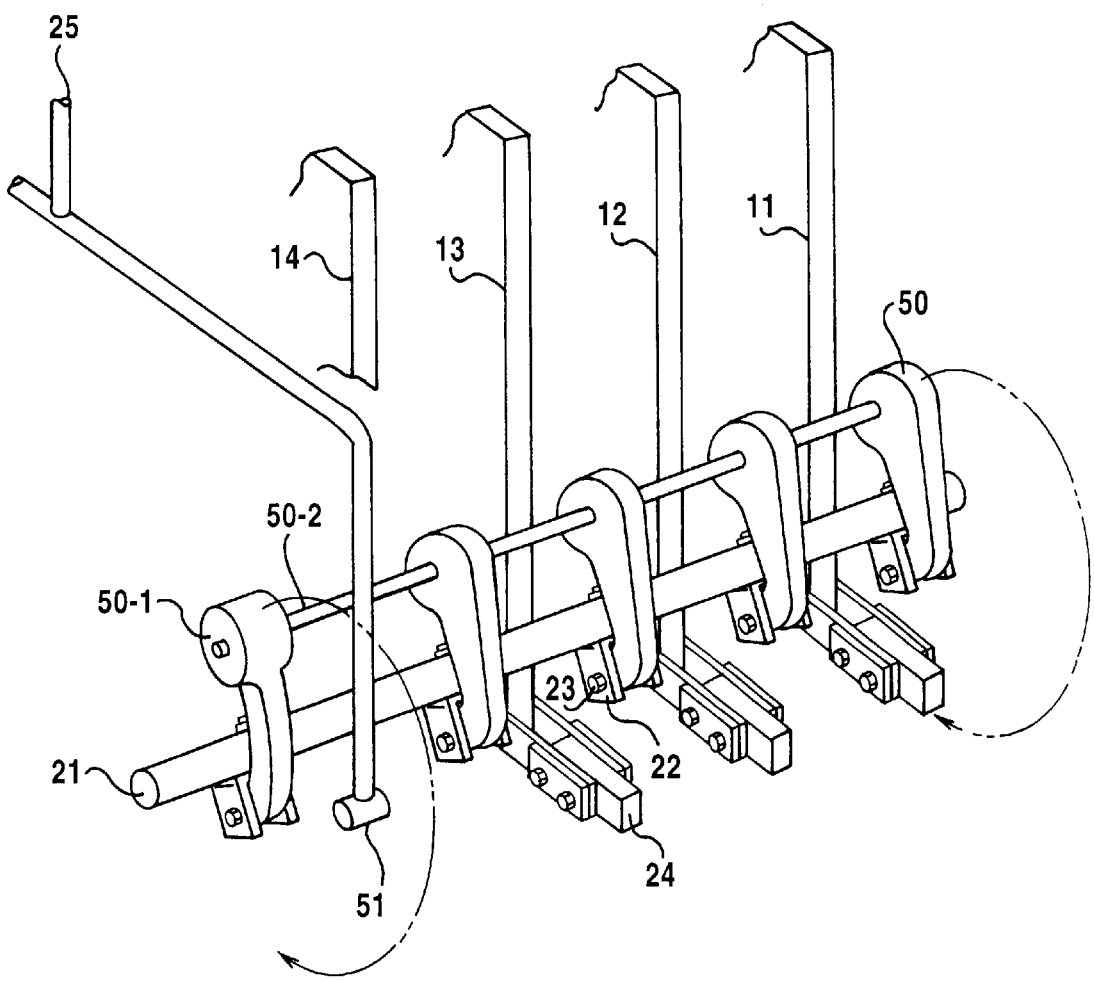
FIG. 11 is a view illustrating configuration of a hammering assembly and a spark electrode in an electric dust precipitator according to a second embodiment of the present invention.
Figure 12:
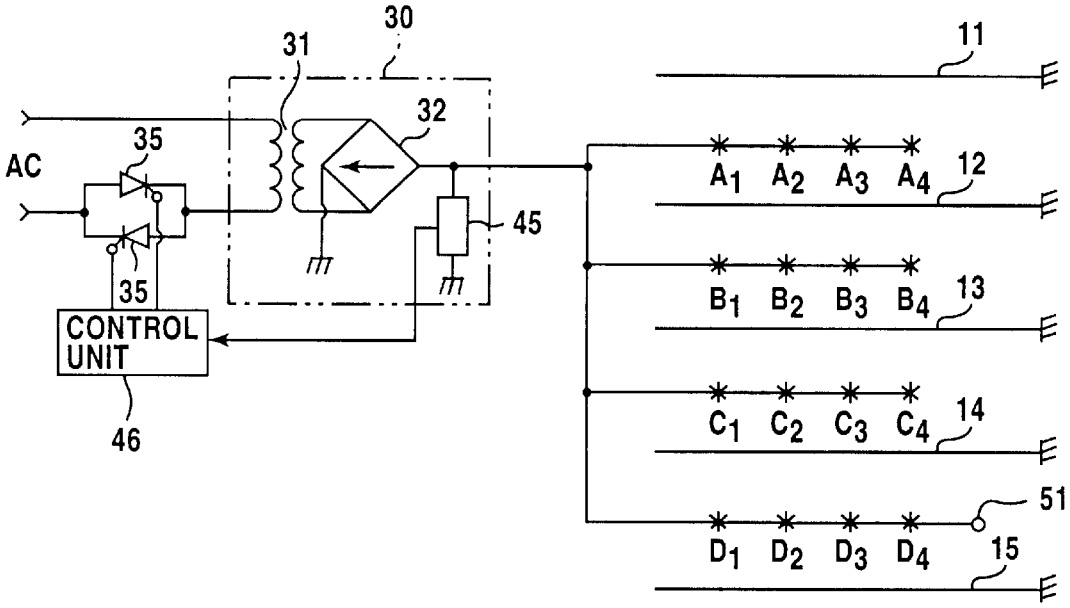
FIG. 12 is a view illustrating electrical connections between a power supply unit and discharge electrodes in the electric dust precipitator shown in FIG. 11.

Referring to FIGS. 11 and 12, an electric dust precipitator according to a second embodiment of the present invention is described. The electric dust precipitator of this second embodiment can eliminate the slight deterioration of the dust collecting performance which otherwise would occur in the electric dust precipitator of the above-mentioned first embodiment. In this embodiment, description also proceeds for a case where five collecting electrodes 11 through 15 (the collecting electrode 15 is omitted in FIG. 11) are provided for each charging division housing in the electric dust precipitator and discharge electrodes A1 through A4, B1 through B4, C1 through C4, and D1 through D4 are aligned between the adjacent respective collecting electrodes. Similar component parts to those in FIGS. 4 and 5 are depicted by the same reference numerals and detailed description thereof will be omitted. In FIG. 11, the second embodiment is different from the first embodiment in the following. The five hammers 50 are attached to the shaft 21 at the same angle. This is for ensuring simultaneous hammering to the five collecting electrodes by the five hammers 50. Only one of these five hammers 50 has the head portions 50-1 on both sides thereof that are described in conjunction with FIG. 4. A spark electrode 51 is connected to all discharge electrodes and is located in the vicinity of the passageway of the only hammer 50 that has the head portions 50-1.

In FIG. 12, all discharge electrodes A1 through A4, B1 through B4, C1 through C4, and D1 through D4 are connected to the power supply unit 30 without passing through the diodes 42 and the resistor 43 described in conjunction with FIG. 5. Of course, the resistor 44 is not necessary.

As described above, the hammering assemblies for the collecting electrodes according to this embodiment have the hammers 50 aligned at the same angle with respect to the shaft 21 such that the all collecting electrodes are struck by the hammers 50 at the same time. A connecting rod 50-2 may be used to couple the hammers 50 to each other in order to ensure positive and simultaneous movement of all hammers 50. In FIG. 11, the spark electrode 51 is provided in the vicinity of the passageway of one hammer 50 with the spark electrode 51 being electrically connected to all of the discharge electrodes. However, a spark electrode electrically connected to all discharge electrodes may be provided near the passageway of a hammer-shaped member (moving body) that is designed to swing generally in synchronism with the connecting rod 50-2 or the hammers 50 and the spark may be generated between the connecting rod 50-2 or the hammer-shaped member and the spark electrode upon the swing of the hammer-shaped member or the connecting rod. The spark electrode 51 may be positioned such that it contacts with the hammer 50 having the head portions 50-1, as described in conjunction with FIG. 6.

As in the first embodiment, the electric dust precipitator comprises the spark detection voltage divider 45 which detects a spark when the discharge electrode is grounded by means of sparking by the spark electrode 51. In response to the detection of the spark, a control unit 46 carries out control to disconnect the output of the power supply unit 30 for 0.008–1 second(s).

The second embodiment does not use the diodes 42 illustrated in FIG. 5. Although the diodes 42 are generally hard to operate well in a high temperature atmosphere of higher than 100° C., this embodiment eliminates such a temperature-related limitation.

The hammers 50 are mounted on the shaft 21 and rotation of the shaft 21 lifts the hammers 50 to the uppermost point of their movement at the same time. The hammers 50 then swing at the same time due to the gravity since they are connected to each other via the connecting rod 50-2 and strike the corresponding struck seats 24 simultaneously that are provided at the lowermost portion of the corresponding collecting electrodes 11 through 15. The hammer 50 having the head portions 50-1 passes by the spark electrode 51 in the course of its swing movement, during which the spark is generated between that hammer 50 and the spark electrode 51. The control unit 46 detects the spark by means of the spark detection voltage divider 45 and disconnects ignition of the thyristors 35 in the primary circuit of the power supply unit 30 for a period ranging from 0.008 seconds (equal to the half-cycle of the power frequency) to 1 second. The power supply unit 30 ceases production of the output for this period.

This spark causes all discharge electrodes to be grounded and the voltage becomes zero accordingly. The power supply unit 30 produces no output during the period of 0.008–1 second(s) after the sparking and all discharge electrodes are at the voltage level of zero during this period of time. The spark occurs during the swing movement of the hammers 50 due to the gravity and the all discharge electrodes are at the voltage level of zero at the moment when the hammers strike the corresponding struck seats 24. The hammering is performed at the voltage level of zero, so that the dust can be shaken off sufficiently as in the conventional power off rapping. The number (frequency) of the voltage-off period (or the period when no voltage is applied to) appears significantly small for the zero voltage period of as short as 0.008–1 second(s) and simultaneous hammering against the collecting electrodes. Though this short-time voltage-off period results in slight deterioration of the dust collecting capacity, it occurs less frequently and for a very short period and does not deteriorate the performance of the electric dust precipitator as a whole. If the performance of the electric dust precipitator is evaluated as a time average for the period that is sufficiently longer than the cycle period during which all of the collecting electrodes are struck, the second embodiment of the present invention provides the minimum voltage-off time in total and thus can be considered the last case that deteriorates the performance.

Figure 3:
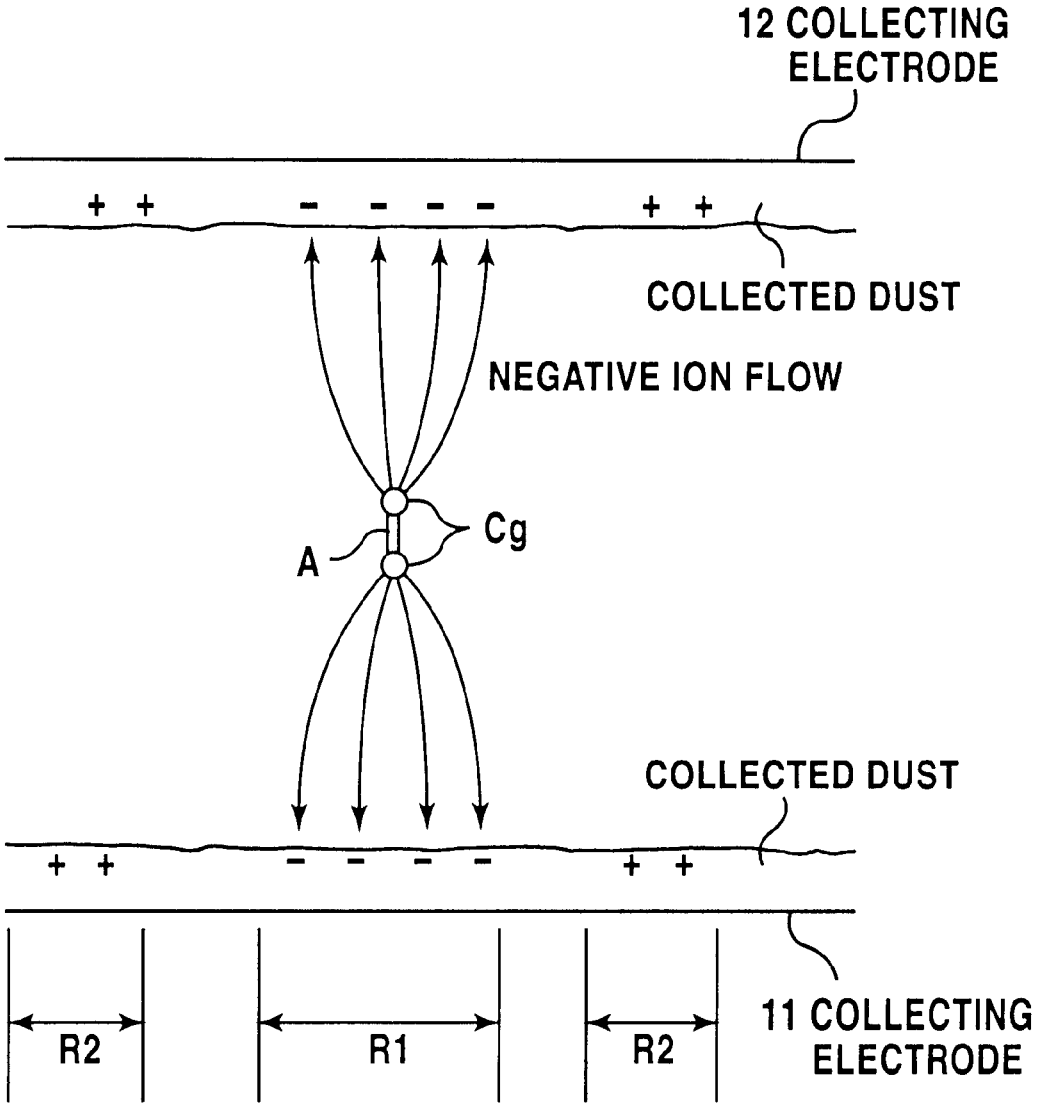
FIG. 3 is a view for use in describing charges accumulated on collected dust deposition on collecting electrodes.

Last but not least, no electrical field exists in the second embodiment because the voltage is zero across the discharge electrodes and the collecting electrodes. This means that the collected dust falls straight down as a mass without being scattered even if the positive charges are accumulated and reside on a part of the collected dust deposition as shown in FIG. 3. Therefore, the separated dust will not re-scatter in the gas flow. Furthermore, the louver-shaped collecting electrodes as shown in FIG. 8 force the separated dust to enter the pocket 11-2 in the louver after a few-centimeter downward movement. The dust is then guided into the dust chute 11-3 through the pocket 11-2 and falls into the hopper. The dust chute 11-3 is completely insulated and separated from the gas passage (duct) and no dust will thus be carried by the gas flow when it falls down.

As described above, the second embodiment is a technique that demonstrates the less or no dangers of producing re-scattered dust carried by the gas flow after the dust is shaken off by the hammering. Accordingly, no puff (a cloud of visible smoke) is generated through a chimney located in the downstream even when the all collecting electrodes are struck at the same time.

The length of the voltage-off period after the spark detection is described. The voltage should be eliminated at least during the period after the generation of the spark between the hammer 50 on its swing movement due to the gravity and the spark electrode 51 and before the all hammers 50 swing to ensure effective hammering to the corresponding collecting electrodes. This period is expected to be longer than the half-cycle of the power frequency (i.e., 0.01 seconds for the areas where 50 Hz is used and 0.0083 seconds for the areas where 60 Hz is used). If the ignition of the primary side thyristor of the power supply unit 30 is eliminated, the half-cycle off is equal to the minimum off-period.

An excessively longer off-period may cause an interval when the electric dust precipitator cannot exhibits its performance. It takes about 3–6 seconds for the gas flow to pass through one charging division housing in the electric dust precipitator. Should the voltage be eliminated during this period of time, the gas that enters the charging division housing in the electric dust precipitator just after the beginning of this period will never be collected and pass through the charging division housing. Therefore, the voltage-off period may be about ⅓ at maximum of the time required for the gas to flow through the charging division housing. The voltage-off time should not be longer than approximately 1 second.

Industrial Applicability

As described above, the electric dust precipitator according to the present invention is suitable for exhaust gas process of a boiler in a thermal electric power plant and of a large refuse incinerator.

What is claimed is:

1. An electric dust precipitator comprising a plurality of collecting electrodes in each charging division housing, each of said plurality of collecting electrodes being provided with a hammering assembly including a hammer, characterized in that:

said hammers are formed so that said collecting electrodes are struck at the same time;

all of the discharge electrodes in each charging division housing being connected so as to be supplied with an output voltage from a common power supply unit and being connected to a common spark electrode;

said spark electrode being positioned so that, just before striking, spark is caused between it and the hammer or a moving body that moves in cooperation with the hammer;

said all of discharge electrodes being provided in common with a ground unit to be grounded just before said collecting electrodes are struck.

2. An electric dust precipitator as claimed in claim 1, further comprising spark detecting means for detecting, as a spark, that said discharge electrodes are grounded, and a control unit that controls said common power supply unit so that an output voltage thereof is turned off for 0.008–1 second in response to detection of the spark by said spark detecting means.

3. An electric dust precipitator as claimed in claim 1, wherein said hammer or said moving body that moves in cooperation with the hammer is configured so as to cause spark between it and said spark electrodes just before striking and to be brought into contact with said spark electrodes.

* * * * *